US010888142B1

(12) United States Patent
Wang et al.

(10) Patent No.: US 10,888,142 B1
(45) Date of Patent: Jan. 12, 2021

(54) SYNCHRONOUS OPENING AND CLOSING STRUCTURE AND BACKPACK WITH THE SAME

(71) Applicant: UNCLESIGN CO., LTD., Taipei (TW)

(72) Inventors: Chi-Sheng Wang, Taipei (TW); Yao-Yu Wu, Taipei (TW); Ju-Huai Lin, Chiayi County (TW)

(73) Assignee: UNCLESIGN CO., LTD., Taipei (TW)

( * ) Notice: Subject to any disclaimer, the term of this patent is extended or adjusted under 35 U.S.C. 154(b) by 0 days.

(21) Appl. No.: 16/565,511

(22) Filed: Sep. 10, 2019

(51) Int. Cl.

| | |
|---|---|
| ***A44B 19/26*** | (2006.01) |
| ***A44B 19/06*** | (2006.01) |
| ***A45F 3/04*** | (2006.01) |

(52) U.S. Cl.
CPC ..... *A44B 19/26* (2013.01); *A44B 19/06* (2013.01); *A45F 3/04* (2013.01)

(58) Field of Classification Search
CPC . Y10T 24/2502; Y10T 24/2504; A44B 19/26; A44B 19/262
USPC ..... 24/382, 385
See application file for complete search history.

(56) References Cited

U.S. PATENT DOCUMENTS

| | | | | |
|---|---|---|---|---|
| 2,178,885 | A * | 11/1939 | Buff | A43C 1/006 24/382 |
| 2,229,216 | A * | 1/1941 | Marinsky | A44B 19/26 24/382 |
| 2,693,013 | A * | 11/1954 | Gossner | A44B 19/32 24/384 |
| 6,742,225 | B2 * | 6/2004 | Marty | A41D 15/04 24/382 |
| 2015/0014109 | A1 * | 1/2015 | Lai | E05B 65/52 190/111 |

* cited by examiner

*Primary Examiner* — Scott T McNurlen
(74) *Attorney, Agent, or Firm* — Li & Cai Intellectual Property Office

(57) ABSTRACT

A synchronous opening and closing structure and a backpack including the same are provided. The synchronous opening and closing structure includes: a first opening and closing structure including a first sliding member and a first tape assembly, wherein the first sliding member is slidably disposed on the first tape assembly so that the first tape assembly is in a closed state or in an open state; a second opening and closing structure including a second sliding member and a second tape assembly, wherein the second sliding member is slidably disposed on the second tape assembly so that the second tape assembly is in the closed state or in the open state; and a connecting structure including a connector connecting the first sliding member and the second sliding member, wherein the connector moves to a first direction and a second direction opposite to the first direction.

6 Claims, 4 Drawing Sheets

SYNCHRONOUS OPENING AND CLOSING STRUCTURE AND BACKPACK WITH THE SAME

FIELD OF THE DISCLOSURE

The present disclosure relates to an opening and closing structure and a backpack, and more particularly to an opening and closing structure having a linking pull function and a backpack including the matching structure.

BACKGROUND OF THE DISCLOSURE

In the related art, opening and closing structures, such as zippers, have been applied to various aspects of people's lives, such as clothes, pants, luggage, backpacks, and the like. However, people sometimes forget to pull the zipper up, especially the zipper on the backpack, so that possessions in the backpack are exposed resulting in theft or loss of the possessions.

SUMMARY OF THE DISCLOSURE

In response to the above-referenced technical inadequacies, the present disclosure provides a synchronous opening and closing structure including: a first opening and closing structure including a first sliding member and a first tape assembly, the first sliding member being slidably disposed on the first tape assembly so that the first tape assembly is in a closed state or in an open state; a second opening and closing structure including a second sliding member and a second tape assembly, and the second sliding member is slidably disposed on the second tape assembly so that the second tape assembly is in the closed state or in the open state; and a connecting structure including a connector connecting the first sliding member and the second sliding member. The connector moves to a first direction and a second direction opposite to the first direction. When the connector moves toward the second direction, the first sliding member and the second sliding structure slide to the second direction, so that the first tape assembly is in the open state and the second tape assembly is in the closed state; when the connector moves in the first direction, the first sliding member and the second sliding structure are synchronously driven to slide along the first direction, so that the first tape assembly is in the closed state and the second tape assembly is in the open state.

In certain embodiments, the first sliding member and the second sliding structure are spaced apart from each other.

In certain embodiments, the first sliding member and the second sliding structure are staggered from each other and parallel to each other.

In certain embodiments, the second sliding structure and the first sliding member slide synchronously by being linked with each other through the connector.

In certain embodiments, the first tape assembly includes a first left tape and a first right tape, the first left tape includes a first left zipper rack, the first right tape is disposed with a first right zipper rack, and the first left zipper rack and the first right zipper rack are meshingly engaged or disengaged with each other. When the first sliding member slides toward the first direction, the first left zipper rack and the first right zipper rack are meshingly engaged with each other so that the first tape assembly is in the closed state, and when the first sliding member slides in the second direction, the first left zipper rack and the first right zipper rack are disengaged with each other, so that the first tape assembly is in the open state. The second tape assembly includes a second left tape and a second right tape, the second left tape is disposed with a second left zipper rack, the first second tape is disposed with a second right zipper rack, and the second left zipper rack and the second right zipper rack are meshingly engaged or disengaged with each other. When the second sliding member slides toward the first direction, the second left zipper rack and the second right zipper rack are meshingly engaged with each other, so that the second tape assembly is in the closed state, and when the second sliding member slides in the second direction, the second left zipper rack and the second right zipper rack are disengaged with each other, so that the second tape assembly is in the open state.

In one aspect, the present disclosure provides an opening and closing structure and a backpack with a matching structure. A connecting structure includes a connector connecting the first sliding member and the second sliding structure, and the connector moves to a first direction and a second direction opposite to the first direction. The connector moves to a first direction and a second direction opposite to the first direction. When the connector moves toward the second direction, the first sliding member and the second sliding structure slide along the second direction, so that the first tape assembly is in the open state and the second tape assembly is in the closed state. When the connector moves toward the first direction, the first sliding member and the second sliding structure slide to along the first direction, so that the first tape assembly is in the closed state and the second tape assembly is in the open state.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
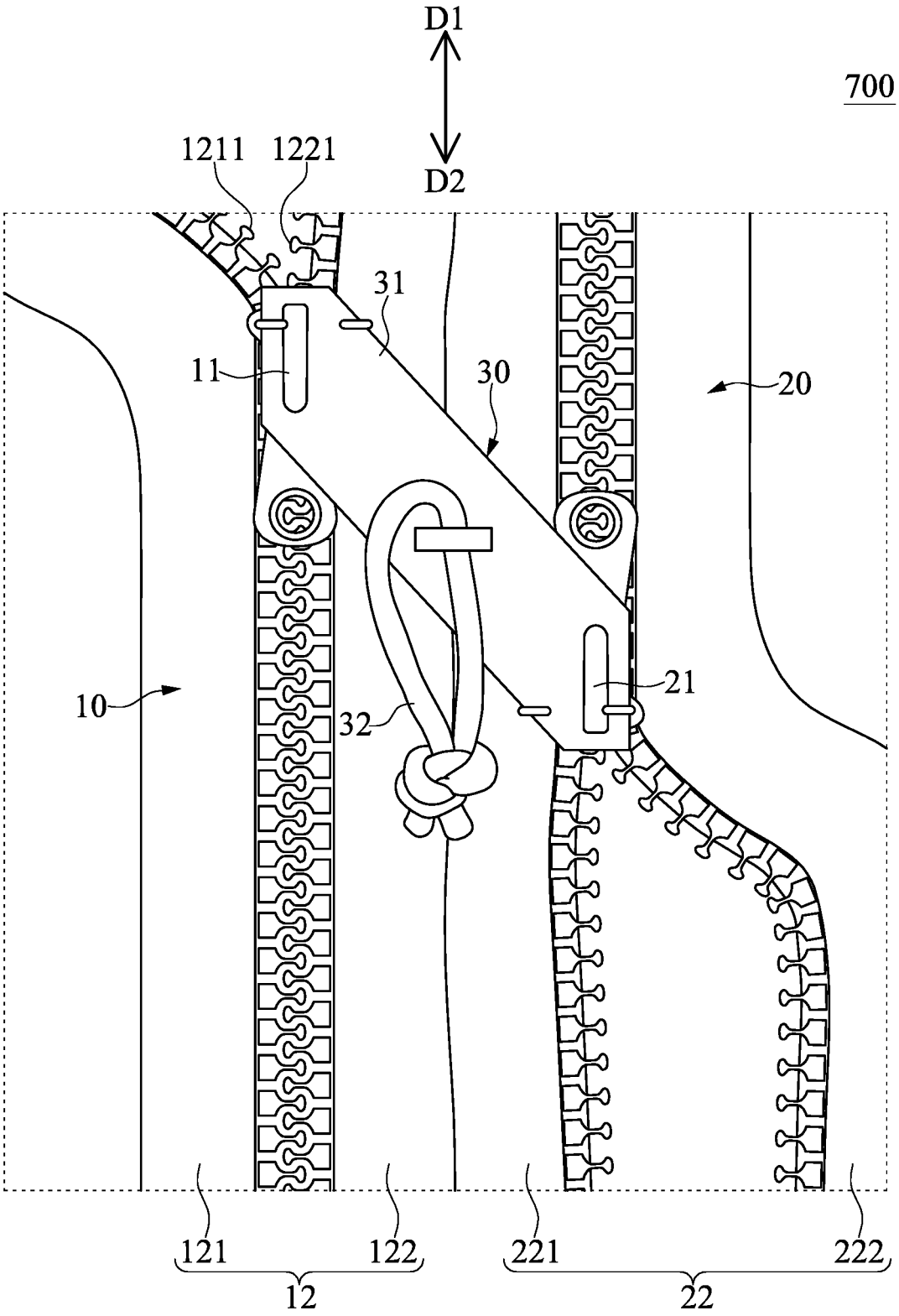
FIG. 1 is a schematic view of an opening and closing structure of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
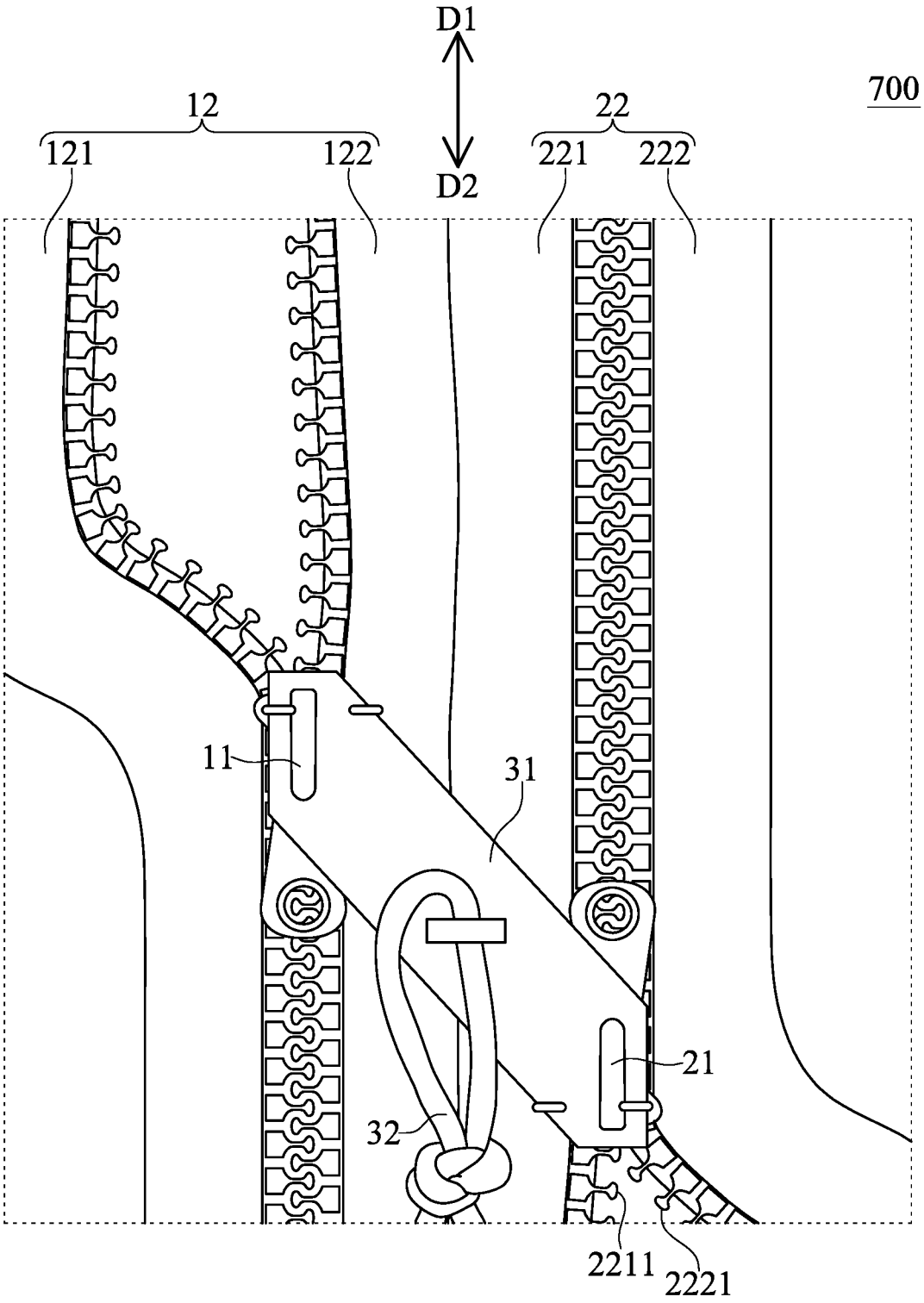
FIG. 2 is a schematic view of the opening and closing structure of the present disclosure.

Referring to FIG. 1 and FIG. 2, one embodiment of the present disclosure provides an opening and closing structure (hereinafter referred to as "opening and closing structure 700"), which is an opening and closing structure to be disposed on a backpack, and can also be disposed on clothes, pants or suitcases.

As shown in FIG. 1 and FIG. 2, the opening and closing structure 700 basically includes a first opening and closing structure 10, a second opening and closing structure 20, and a connecting structure 30.

The first opening and closing structure 10 includes a first sliding member 11 and a first tape assembly 12, and the first sliding member 11 is slidably disposed on the first tape assembly 12, so that the first tape assembly 12 can be pulled up or in an open state.

The second opening and closing structure 20 includes a second sliding member 21 and a second tape assembly 22, and the second sliding member 21 is slidably disposed on the second tape assembly 22, so that the second tape assembly 22 can be pulled up or in the open state.

Further, the first sliding member 11 can slide to the first direction D1 (upwardly), so that the first tape assembly 12 is pulled up (as shown in FIG. 1); the first sliding member 11 can slide to the second direction D2 (downwardly), so that the first tape assembly 12 is in the open state (as shown in FIG. 2).

Conversely, the second sliding member 21 can slide in a first direction D1 (upwardly), and the second tape assembly 22 can be in the open state (as shown in FIG. 1); the second sliding member 21 can slide to a second direction D2 (downwardly), and the second tape assembly 22 can be in pulled up (as shown in FIG. 2).

In the present embodiment, the first sliding member 11 and the second sliding member 21 are spaced apart from each other. Preferably, the first sliding member 11 and the second sliding member 21 are staggered from each other and parallel to each other.

The connecting structure 30 includes a connector 31, and the first sliding member 11 is connected to the second sliding member 21 by the connector 31. Preferably, the connector 31 is an oblique transverse plate, and the first sliding member 11 and the second sliding member 21 are connected obliquely by the connector 31. Therefore, as the first sliding member 11 slides, the second sliding member 21 can be synchronously slid through the connector 31. It can also be said that when the second sliding member 21 slides, the first sliding member 11 can be synchronously slid through the connector 31.

Moreover, the connector 31 can move to the first direction D1 or the second direction D2. When the connector 31 moves to the second direction D2, the first sliding member 11 and the second sliding member 21 can be synchronously slide to along to the second direction D2, so that the first tape assembly 12 is in the open state and the second tape assembly 22 is pulled up. When the connector 31 moves to the first direction D1, the first sliding member 11 and the second sliding member 21 can be synchronously slide to along the first direction D1, so that the first tape assembly 12 is pulled and the second tape assembly 22 is in the open state.

The connecting structure 30 further includes a puller 32 connected to the connector 31. The puller 32 can be a pull ring to facilitate pulling of the connector 31.

In this embodiment, each of the first sliding member 11 and the second sliding member 21 may respectively be a zipper slider, but may also be other components having similar functions, such as a component that slides over an opening of the sealed bag and is used to close and open the opening of the sealed bag.

The first tape assembly 12 includes a first left tape 121 and a first right tape 122. The first left tape 121 has a first left zipper rack 1211, and the first right tape 122 has a first right zipper rack 1221. The first left zipper rack 1211 and the first right zipper rack 1221 can be meshingly engaged or disengaged. When the first sliding member 11 slides toward the first direction D1 (upwardly), the first left zipper rack 1211 and the first right zipper rack 1221 are meshingly engaged with each other, so that the first tape assembly 12 is pulled up. When the first sliding member 11 slides toward the second direction D2 (downwardly), the first left zipper rack 1211 and the first right zipper rack 1221 are separated from each other, so that the first tape assembly 12 is in the open state.

The second tape assembly 22 includes a second left tape 221 and a second right tape 222. The second left tape 221 is further disposed with a second left zipper rack 2211, and the second right tape 222 is further disposed with a second right zipper rack 2221. The second left zipper rack 2211 and the second right zipper rack 2221 can be meshingly engaged or disengaged from each other. When the second sliding member 21 slides toward the first direction D1 (upwardly), the second left zipper rack 2211 and the second right zipper rack 2221 are separated from each other, so that the second tape assembly 22 is in the open state. When the second sliding member 21 slides toward the second direction D2 (downwardly), the second left zipper rack 2211 and the second right zipper rack 2221 are meshingly engaged with each other, so that the second tape assembly 22 is in the open state.

Figure 3:
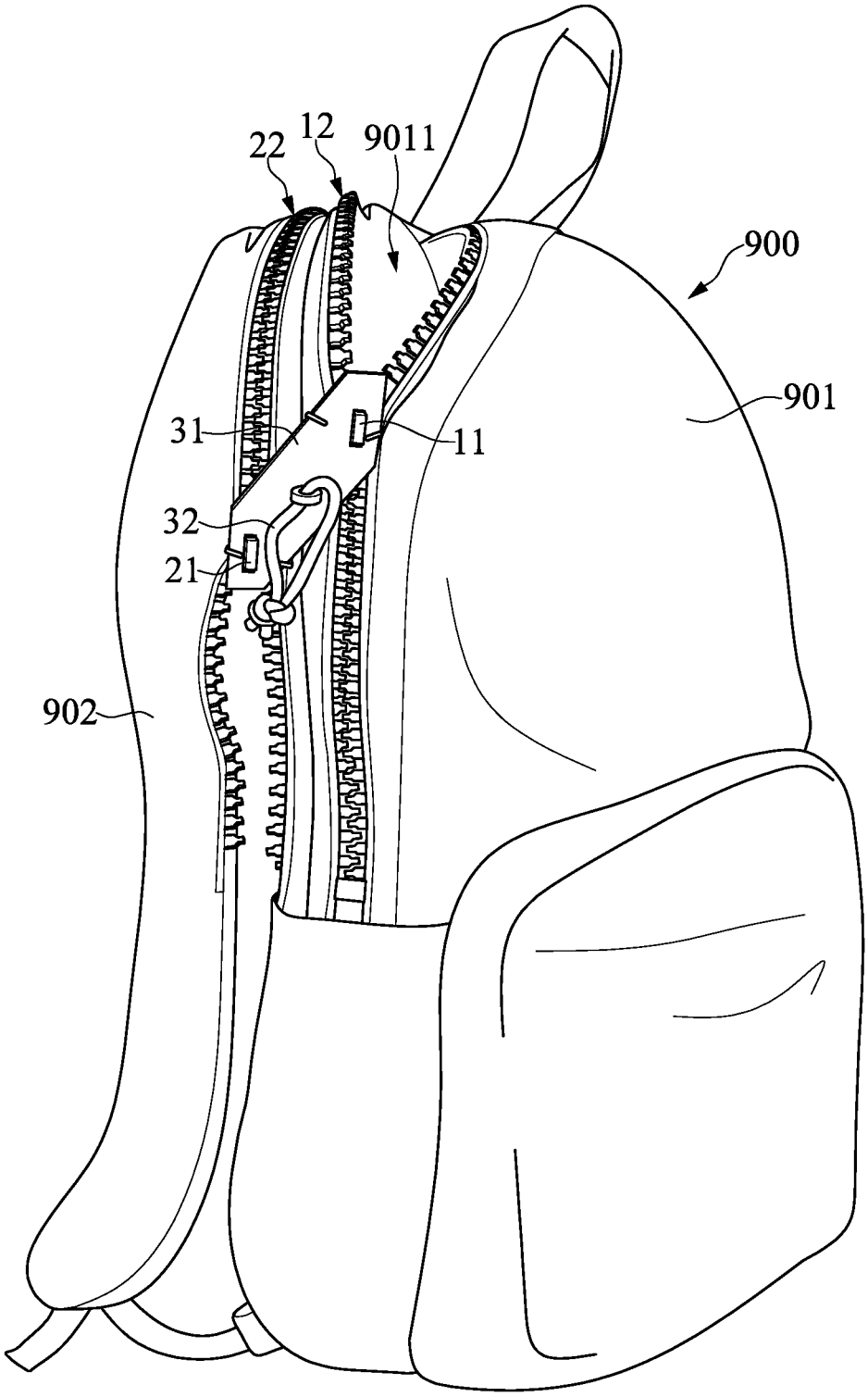
FIG. 3 is a schematic view of a backpack with the opening and closing structure of the present disclosure.
Figure 4:
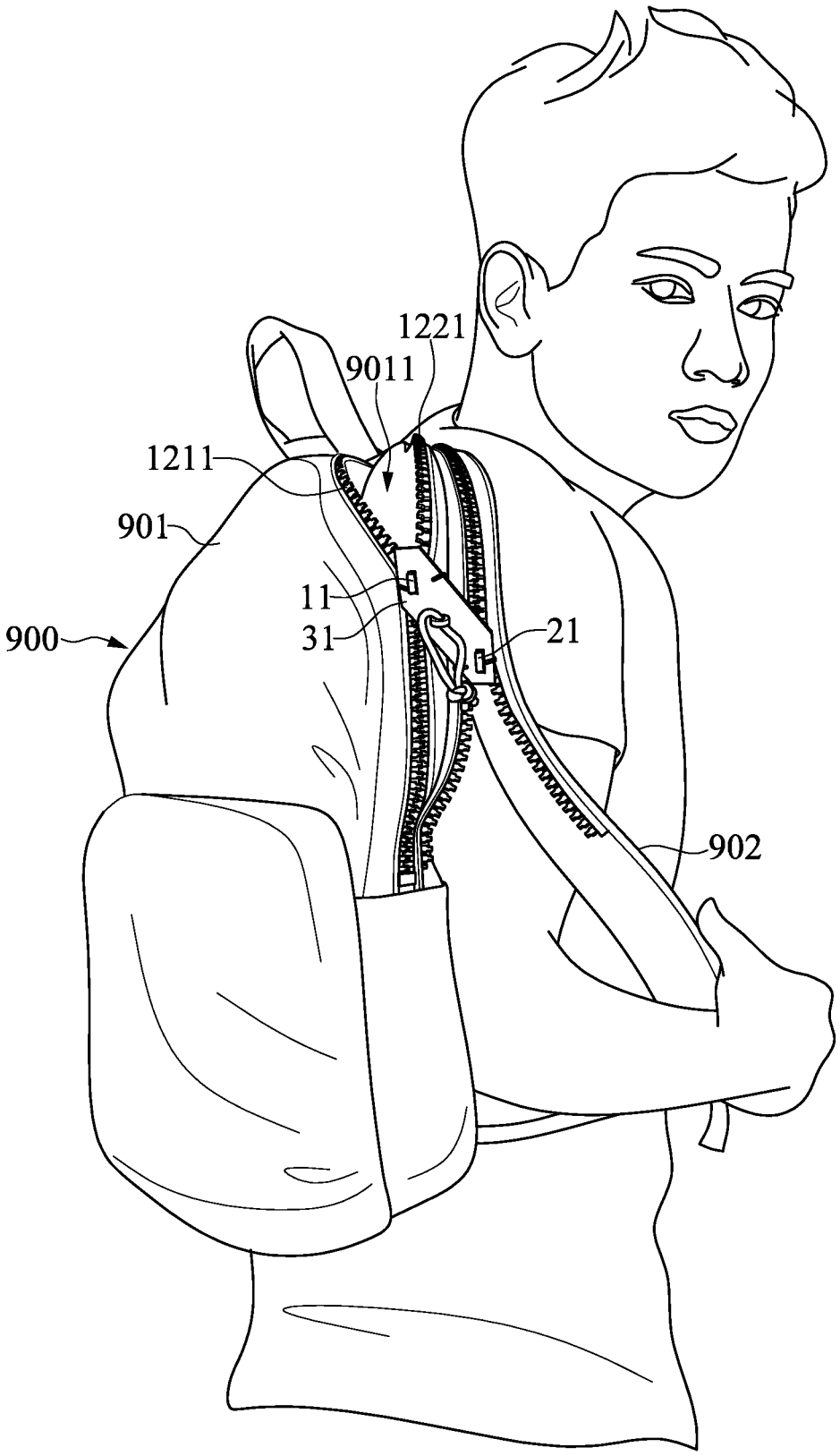
FIG. 4 is a schematic view of the backpack with the opening and closing structure of the present disclosure.

Referring to FIG. 3 and FIG. 4, and referring to FIG. 1 and FIG. 2, the opening and closing structure 700 of the present disclosure can be implemented in combination with a backpack 900. The backpack 900 has a bag body 901 and at least one strap 902 connected to the bag body 901, and the bag body 901 has at least one opening 9011. The first tape assembly 12 is disposed on the periphery of the opening 9011 of the bag body 901, and the second tape assembly 22 is disposed between the side of the bag body 901 and the strap 902. The second left tape 221 and the second left zipper rack 2211 are disposed on the side of the bag body 901, and the second right tape 222 and the second right zipper rack 2221 are disposed on the strap 902.

As described above, when a user wants to take an item out from the backpack 900, the connector 31 can be pulled down through the puller 32 to move the connector 31 downward, so that the first tape assembly 12 is in the open state. When the first tape assembly 12 is in the open state, the opening 9011 will be exposed to the user for the user to take the item through the opening 9011. Moreover, as shown in FIG. 4, when the user wants to carry the backpack 900, as long as his or her arm passes through or pulls the strap 902 to separate the zippered rack of the second tape assembly 22, the second sliding member 21 can be driven to slide upwards, and the first sliding member 11 is synchronously slid upward through the connector 31, so that the first left zipper rack 1211 disposed at the periphery of the opening 9011 of the bag body 901 and the first right zipper rack 1221 are meshingly engaged with each other, and the first tape assembly 12 can be pulled up, thereby concealing the opening 9011. Therefore, as long as the user's arm passes through or pulls the strap 902 when carrying the backrest 900, the first tape assembly 12 can be pulled up, thereby effectively avoiding the problem of forgetting to pull up the zipper of the backpack 900.

It should be noted that, since the first sliding member 11 and the second sliding member 21 are staggered from each other in the up and down directions, that is, the first sliding member 11 is located relatively above the second sliding member 21 and the second sliding member 21 is located relatively below the first sliding member 11, when the second sliding member 21 is slid upward, the first sliding member 11 can be smoothly slid upward through the connector 31.

In summary, regarding the opening and closing structure having linking function and the backpack having the opening and closing structure provided by the present disclosure, the first sliding member 11 and the second sliding member 21 are connected through the connector 31, and the connector 31 can move to a first direction and a second direction opposite to the first direction. When the connector 31 moves to the second direction, the first sliding member 11 and the second sliding member 21 are slide to along the second direction, so that the first tape assembly 12 is in the open state and the second tape assembly 22 is pulled up. When the connector 31 moves to the first direction, the first sliding member 11 and the second sliding member 21 are slide to along the first direction, so that the first tape assembly 12 is pulled up and the second tape assembly 22 is in the open state. Therefore, as the connector 31 slides, the first tape assembly 12 and the second tape assembly 22 are in the opposite states. Therefore, as long as the user's arm passes through or pulls the strap when carrying the backrest, the first tape assembly 12 can be pulled up, thereby effectively preventing the problem of forgetting to pull up the zipper of the backpack.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A synchronous opening and closing structure, comprising:

a first opening and closing structure including a first sliding member and a first tape assembly, wherein the first sliding member is slidably disposed on the first tape assembly so that the first tape assembly is in a closed state or in an open state;

a second opening and closing structure including a second sliding member and a second tape assembly, wherein the second sliding member is slidably disposed on the second tape assembly so that the second tape assembly is in the closed state or in the open state; and a connecting structure including a connector connecting the first sliding member and the second sliding member, wherein the connector moves in a first direction and a second direction opposite to the first direction, when the connector moves in the second direction, the first sliding member and the second sliding member slide to the second direction, so that the first tape assembly is in the open state and the second tape assembly is in the closed state; when the connector moves toward the first direction, the first sliding member and the second sliding member slide to the first direction, so that the first tape assembly is in the closed state and the second tape assembly is in the open state;

wherein the first sliding member and the second sliding member are spaced apart from each other, and wherein the first sliding member and the second sliding member are staggered from each other and parallel to each other.

2. The synchronous opening and closing structure according to claim 1, wherein the second sliding member and the first sliding member slide synchronously by being linked with each other through the connector.

3. A backpack with an opening and closing structure, comprising:

a bag body and at least one strap connected to the bag body; wherein the bag body has an opening;

a first opening and closing structure including a first sliding member and a first tape assembly disposed on the circumference of the opening; wherein the first sliding member is slidably disposed on the first tape assembly to enable the first tape assembly to be in a closed state or in an open state;

a second opening and closing structure including a second sliding member and a second tape assembly disposed between the side of the bag body and the strap, wherein the second sliding member is slidably disposed on the second tape assembly to enable the second tape assembly to be in the closed state or in the open state; and a connecting structure including a connector connecting the first sliding member and the second sliding member, wherein the connector can move to a first direction and a second direction opposite to the first direction, when the connector moves toward the second direction, the first sliding member and the second sliding member slide to the second direction, so that the first tape assembly is in the open state and the second tape assembly is in the closed state; when the connector moves toward the first direction, the first sliding member and the second sliding member slide to the first direction, so that the first tape assembly is in the closed state and the second tape assembly is in the open state.

4. The backpack according to claim 3, wherein the first sliding member and the second sliding structure member are spaced apart from each other.

5. The backpack according to claim 4, wherein the first sliding member and the second sliding member are staggered from each other and parallel to each other.

6. The backpack according to claim 3, wherein the second sliding member and the first sliding member slide synchronously by being linked with each other through the connector.

* * * * *